United States Patent [19]

Popeck

[11] Patent Number: 4,935,715

[45] Date of Patent: Jun. 19, 1990

[54] SECTIONALIZER WITH EXTERNALLY MOUNTED ELECTRONIC CONTROLLER

[75] Inventor: Charles A. Popeck, Centralia, Mo.

[73] Assignee: A. B. Chance Company, Centralia, Mo.

[21] Appl. No.: 287,896

[22] Filed: Dec. 21, 1988

[51] Int. Cl.[5] ..... H01H 71/10

[52] U.S. Cl. ..... 337/169; 361/115

[58] Field of Search ..... 337/169, 171, 175, 168, 337/170, 172, 173, 174, 176, 178, 179; 361/115; 335/32

[56] References Cited

U.S. PATENT DOCUMENTS

| | | | |
|---|---|---|---|
| 3,321,721 | 5/1967 | Smith, Jr. . | |
| 4,553,188 | 11/1985 | Aubrey et al. | 361/115 |
| 4,768,010 | 8/1988 | Brown et al. | 337/169 |
| 4,795,996 | 1/1989 | Brown et al. | 337/169 |

*Primary Examiner*—H. Broome

*Attorney, Agent, or Firm*—Hovey, Williams, Timmons & Collins

[57] ABSTRACT

An electronic sectionalizer includes mounting structure including first and second electrical contacts spaced from one another and electrically conductive structure having an external surface and provided with first and second electrical terminals adapted to engage the first and second electrical contacts of the mounting structure in a closed condition of thesectionalizer. The sectionalizer provides for the release of the electrically conductive structure from engagement with at least the first electrical contact to permit the electrically conductive structure to move from the closed position to an open position, and an actuator is provided for actuating the release. A detector is provided to detect a predetermined condition in the sectionalizier and the actuator is controlled in response to the detection by an electronic control circuit mounted to the external surface of the conductor.

17 Claims, 2 Drawing Sheets

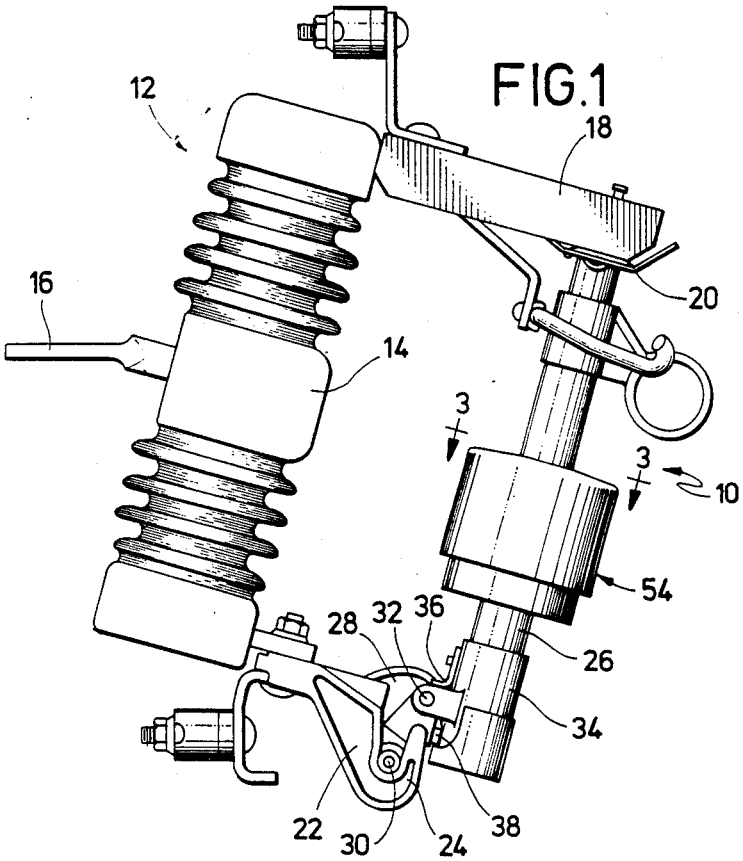
FIG.1
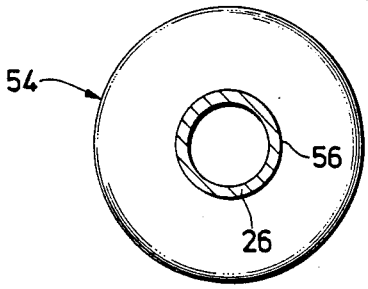
FIG.3
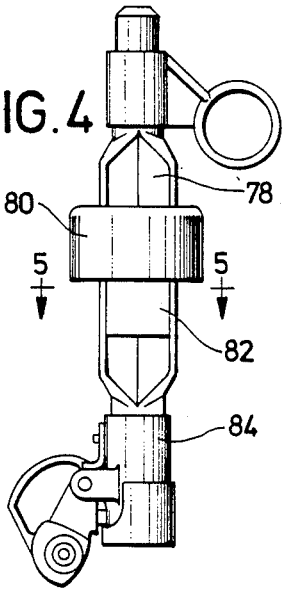
FIG.4
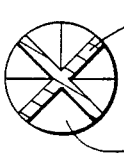
FIG.6
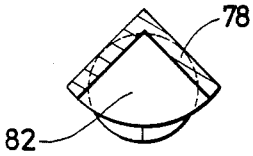
FIG.5
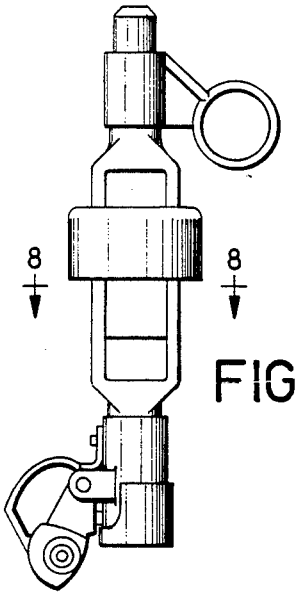
FIG.7
FIG.8
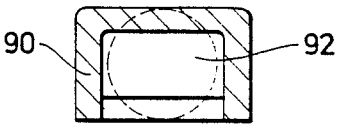
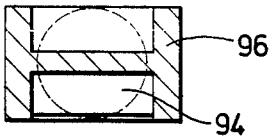
FIG.9
FIG.10
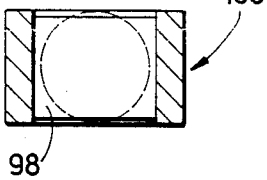

SECTIONALIZER WITH EXTERNALLY MOUNTED ELECTRONIC CONTROLLER

BACKGROUND OF THE INVENTION

1. Field of the Invention

The present invention relates generally to electronic sectionalizers and, more particularly, to an electronic sectionalizer having a conductor provided with an electronics package mounted on the external surface thereof.

2. Discussion of the Prior Art

High voltage power distribution systems are typically comprised of a main supply line that is connected to a number of branch or lateral lines. Normally, the main line is protected near its source of power by an automatic recloser or a reclosing circuit breaker which is operable to disable the entire system downstream of the recloser if currents above a certain magnitude are detected. Automatic reclosers and reclosing circuit breakers are particularly useful for enabling transient fault currents to clear after which time the recloser can again energize the circuit. However, if fault current conditions remain, the recloser after one or more attempts to re-energize the circuit will cease operation and cause the distribution system to remain in a deactivated state until attended by a repairman.

In the past, fuse links were often installed at the beginning of each lateral line to protect the line and isolate it from the rest of the distribution system where over-current conditions existed only in a particular lateral line. Many problems were observed, however, in attempting to coordinate the opening characteristics of the fuse links with the reclosing apparatus and in attempting to ensure that the fuse link would not melt and open the lateral line before the reclosing apparatus had an opportunity to deactivate the entire system. As a consequence, electronic sectionalizers have been developed which instead count the number of times that the recloser opens and closes the circuit. After a specified number of current flow periods or "shots", the electronic sectionalizer disables the lateral line during a subsequent dead interval when the reclosing apparatus has opened if over-current conditions in the lateral line protected by the sectionalizer are detected. For additional disclosure of electronic sectionalizers, reference is hereby made to U.S. Pat. No. 4,553,188 dated Nov. 12, 1985, and to U.S Pat. No. 4,768,010 dated Aug. 30, 1988.

In the aforementioned U.S. Pat. No. 4,553,188, an electronic sectionalizer is disclosed in which a metal casing provides a current path across a fuse mounting while the sectionalizer is in a conducting position. An electronic circuit inside the tube detects at least two successive current surges through the casing and, during the following dead period, actuates a chemical actuator to trip the sectionalizer out of its conducting position. By mounting the electronic circuit inside the casing, the circuit is protected against undesirable effects of electromagnetic interference produced by the high currents and high voltages associated with the sectionalizer.

However, although the internally mounted electronic circuit construction provides the advantage of protection to the circuit against electro-magnetic interference, this type of construction suffers numerous drawbacks. For example, by placing the electronic circuit inside the casing, it is exposed to the high temperatures present in the casing and will run hot and thus be susceptible to variations and premature aging.

In addition, because the hollow space within the casing is dedicated to the storage of the electronic circuit, it is not possible to mount other elements of the sectionalizer inside the casing. Such a consequence is not critical to the sectionalizer illustrated in the above-mentioned U.S. Pat. No. 4,553,188, since that sectionalizer may not be reset and does not require additional elements to carry out either the release or resetting of the casing. However, it would be desirable to provide a construction which permits all necessary components of the sectionalizer, as well as any other optional components to be provided, in as compact an assembly as possible.

Another drawback of employing an internally mounted electronic circuit is that the size of the circuit is limited to a size capable of being fitted into the internal space of the casing. Because of this limitation, the number of features capable of use in the construction is limited by the size of the casing. Other encumbrances of the internally mounted electronic circuit also exist. For example, the internally mounted electronic circuit precludes access to the circuit so that, once mounted in the casing, it becomes very difficult to perform any programming of the circuit. In addition, it is difficult to connect the circuit to the detecting circuit employed in the sectionalizer.

OBJECTS AND SUMMARY OF THE INVENTION

It is an object of the present invention to provide an electronic sectionalizer which employs an externally mounted electronic circuit which may be easily programmed after installation to permit optional or additional features to be employed in the sectionalizer.

Another object of the invention resides in providing a sectionalizer in which the electronic circuit is removed from the high temperature region within the casing of the conductor so that the circuit will run cooler, and thus be less susceptible to variations and premature aging.

Further, by providing a sectionalizer having an externally mounted electronic circuit, it is a further object of the present invention to permit the interior of a conductor to be employed for other purposes such as for use in storing resetting means.

An example of an electronic sectionalizer which may be reset is illustrated in co-pending U.S patent application Ser. No. 128,688 filed on Dec. 4, 1987, now U.S. Pat. No. 4,795,996, and entitled "Electronic Sectionalizer with Resettable Actuator". The disclosure of this co-pending application is incorporated herein by this express reference and makes up a part of the present application. As can be seen from a review of the co-pending application, the interior of the conductor receives an electromagnetic actuator and a linkage system which are used for triggering the release of the conductor from the contacts of the mounting structure of the sectionalizer in a resettable fashion.

In order to provide this resettable construction, it is necessary to relocate the electronic circuit from the conventional location within the casing of the conductor. As mentioned in the background, it was previously considered desirable to locate the electronic circuit within the casing of the conductor so as to protect the electronic components from the undesirable effects of electromagnetic interference produced by the high currents and high voltages associated with the sectionalizer. However, the present invention permits the use of an externally mounted electronic circuit while protecting the electronic circuit from electromagnetic interference, as well as from the harsh environment surrounding the conductor.

According to one aspect of the invention, a sectionalizer apparatus includes mounting structure including first and second electrical contacts spaced from one another and rigid electrically conductive structure having an external surface and provided with first and second electrical terminals adapted to engage the first and second electrical contacts of the mounting structure when the sectionalizer is in a closed condition. Release means are provided for releasing the electrically conductive structure from engagement with at least the first electrical contact to permit the electrically conductive structure to move from the closed position to an open position, and actuating means actuate the release means. The apparatus further includes control means for detecting a condition in the sectionalizer and for controlling the actuator in response to the detection. The control means includes an electronic control circuit mounted to the external surface of the conductive structure. The conductive structure is capable of carrying the normal electrical current load imposed on the sectionalizer in use, and is of sufficient structural strength to support the control means and carry the compressive load applied on the conductive structure by the contacts when the structure is in the closed condition.

In its preferred form, the sectionalizer includes a tubular conductive element and the control means includes a detector and electronic control circuit which are both mounted to the external surface of the conductive element. In addition, a housing is preferably provided which positions the control means relative to the electrically conductive structure and which protects the control means from exposure to the environment. The condition sensed by the control means may be a period of current flow including a surge of current through the electrically conductive structure followed by a current dead interval, and the actuator is preferably triggered after some predetermined number of current flow periods. This predetermined number may be made adjustable by providing an adjustment means on the control circuit.

By providing a sectionalizer apparatus in accordance with the invention, it is possible to position the electronic control circuit in close proximity to the detector of the control means so that relatively short connections are required between the circuit and detectors, and the entire control means may be assembled as a unit and be tested prior to being installed on the sectionalizer. Thus, if a defective control circuit is detected during production of a sectionalizer, it is possible to replace only the control circuit rather than the entire sectionalizer.

BRIEF DESCRIPTION OF THE DRAWING FIGURES

A detailed description of a preferred embodiment of the invention is provided below with reference to the attached drawing figures, wherein:

FIG. 1 is a side view of an electronic sectionalizer constructed in accordance with the present invention;

FIG. 3 is a cross-sectional plan view of the tubular conductive member of FIG. 1;

FIG. 4 is a side view of a first alternate construction of the conductive member;

FIG. 5 is a cross-sectional view of a second alternate construction of the conductive member;

FIG. 6 is a cross-sectional view of a third alternate construction of the conductive member;

FIG. 7 is a side view of a fourth alternate construction of the conductive member;

FIG. 8 is a cross-sectional view of the fourth construction taken along line 8—8 of FIG. 7;

FIG. 9 is a cross-sectional view of a fifth alternate construction of the conductive member;

FIG. 10 is a cross-sectional view of a sixth alternate construction of the conductive member.

DETAILED DESCRIPTION OF A PREFERRED EMBODIMENT

Figure 11:
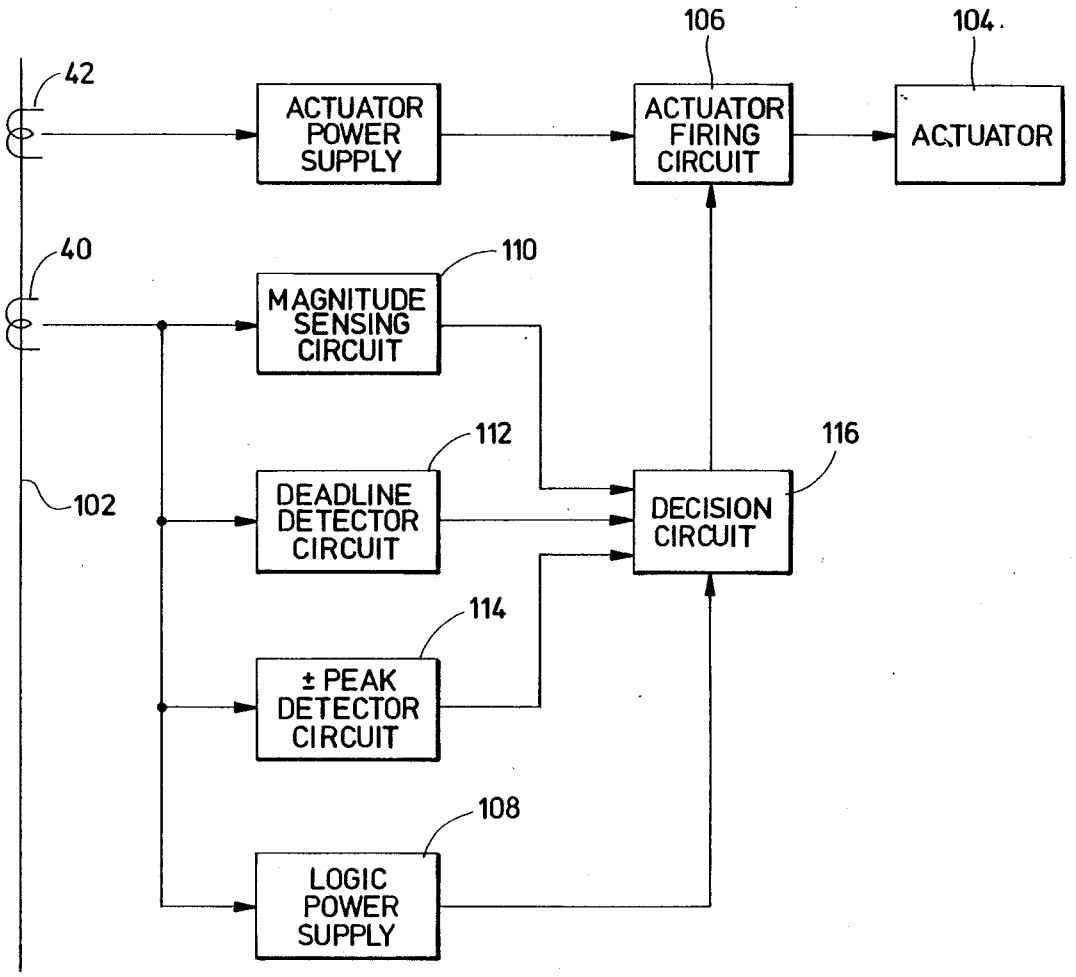
FIG. 11 is a flow diagram of an electrical control circuit made for use in a sectionalizer constructed in accordance with the present invention.

As illustrated in FIG. 1, a sectionalizer 10 is carried by a mounting assembly 12 that includes an insulator 14 having an arm 16 for securing the assembly to a utility pole or the like. The mounting assembly 12 has an upper electrical contact 18 that includes a conductive, downward biased arm 20 having a concave detent, and a lower contact 22 spaced from the upper contact 18 and mounted on an opposite end region of the insulator 14. The lower contact 22 includes a pair of spaced, hook-shaped portions 24 (only one shown) on which the sectionalizer 10 is carried.

Figure 2:
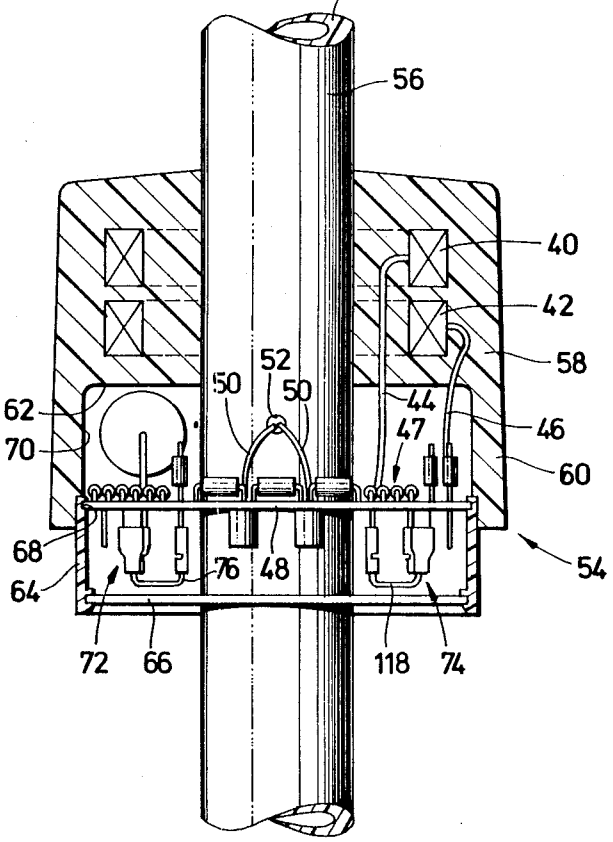
FIG. 2 is a partial side sectional view of the tubular conductive member shown in FIG. 1, and the externally mounted electronic circuit.

The sectionalizer 10 includes an elongated, electrically conductive structure including a conductive element 26 shown as a tube in FIGS. 1–3 with an upper terminus that is received in the concave detent of the arm 20 of the upper contact 18. Release means are provided between the sectionalizer 10 and the mounting assembly 12 for releasing the conductive element 26 from engagement with at least the upper electrical contact 18 to permit the conductive element 26 to move from a closed position of the sectionalizer, such as that shown in FIG. 1, to an open position. The release means includes a trunnion member 28 disposed substantially between the two hook-shaped portions 24 of the lower contact 22 and having a pair of cylindrical pins 30 that extend horizontally outward in opposite directions and which are received in respective hook portions 24.

The trunnion member 28 is pivotally connected by means of a further pin 32 to a lower casting 34 of the conductive element 26. The longitudinal axis of the pin 34 is parallel to the central axis of pins 30 for enabling swinging motion of the trunnion member 28 relative to the conductive element 26 during simultaneous swinging movement of the trunnion member 28 relative to the hook portions 24 of the lower contact 22. A spring contact 36 secured to the lower casting 34 normally engages a raised portion of the trunnion member when the conductive element 26 is in its closed, current-carrying or loaded position as shown in FIG. 1, for facilitating the flow of current from the upper contact 18, along the length of the conductive element 26 and thereby across the trunnion member 28 to the lower contact 22.

A plunger 38 is mounted within a recess of the lower casting 34 and extends through the casting between the conductive element 26 and the trunnion member 28. The plunger 38 is in turn connected to an actuating means (not shown) which may take any one of several forms. In the preferred embodiment, as disclosed in the above-mentioned co-pending application, the actuating means includes a linkage system located within the tubular conductive element 26 which connects the plunger 38 to an electromagnetic solenoid that is also located within the conductive element. The solenoid includes its own power supply, such as a current transformer, and is activated in response to a control means which operates in a manner more fully described below. Activation of the actuator triggers movement of the plunger thus causing relative movement between the conductive element 26, the trunnion member 28 and the lower contact 22. As a result of this relative movement, the conductive element 26 is released from engagement with the upper contact 18 and the conductive element moves to the open position. Because a solenoid is employed as an actuating means in this embodiment, the sectionalizer 10 is resettable and may be utilized repeatedly without replacement.

It is possible to provide other constructions of the actuating means. For example, a detonating actuator may be preferred in certain circumstances such as where the capability of resetting the actuator is not desired or is too expensive for a given application. In this alternate embodiment, the actuator could still be located within the conductive element 26 to ensure protection of the actuator from exposure to the environment, while permitting the sectionalizer 10 to retain many of the advantages already discussed with regard to the preferred embodiment.

In FIG. 2, a control means is shown as being mounted on the external surface of the tubular conductive element. The control means includes a first current transformer 40 which serves the dual roles of a circuit power supply and a detector for sensing a condition in the conductive element 26 such as the current passing therethrough. A second current transformer 42, is also provided which serves as a power source for the actuator as discussed above. The first and second current transformers 40, 42 are connected by leads 44, 46 to an electronic control circuit 47 provided on a printed circuit board 48. Output wires 50 extend from the actuator through an opening 52 in the conductive element 26 and are also connected to the circuit 47.

In an alternate embodiment, it is possible to replace the current transformers 40, 42 with other components serving similar functions to those of the transformers. For example, the first current transformer may be replaced by some other detector, such as a Hall effect transducer, along with an alternate power supply. Such power supply might include a non-rechargeable battery, e.g., of the lithium type, or might be constructed from a rechargeable battery connected with a further current transformer. The second current transformer likewise could be replaced by either of these alternate power supply constructions.

The current transformers 40, 42 and control circuit 47 are mounted within a housing 54 which positions these components relative to the external surface 56 of the conductive element 26. In addition, the housing 54 also protects these components from exposure to the environment and from inadvertent bumping by linemen or others in close proximity to the sectionalizer.

As illustrated in FIG. 3, in the preferred construction of the sectionalizer, the housing 54 includes an annular body 58 formed of a potting compound, such as an epoxy resin, which is mounted on the external surface 56 of the tubular conductive element 26 and secured in place by an adhesive or other known attachment means. This housing body 58 is formed with two current transformers 40, 42 and their associated lead wires 44, 46 embedded therein as shown by FIG. 2. By constructing the housing body 58 in this manner, the two current transformers 40, 42 are securely held in position in the housing 54 and are prevented from being exposed to moisture and other environmental conditions.

An annular flange 60 is formed as a part of the body 58 and extends from one axial end of the body so as to define a cavity 62 in which the circuit board 48 is received. The cavity 62 is closed off from exposure to the environment by a weather shield 64 which extends axially of the cavity and by a snap-in cover 66. The weather shield 64 is preferably constructed of metal-plated plastic or metal such as copper and is formed with an annular groove 68 therein adjacent one of its axial ends for receiving the circuit board 48. Once the board is fitted into the groove 68 of the shield 64, the shield is fastened to an inner surface 70 of the flange, thus encapsulating the circuit board 48 within the housing 54. Thereafter, should it be necessary for adjustments or programming to be carried out, it is only necessary to snap out the cover 66 in order to get access to the circuit board 48. As an alternative, it is possible to partially embed the circuit board in the potting compound so that the bottom side of the board is exposed for programming as described below, or to completely embed the circuit board in the potting compound to ensure protection of the board from environmental conditions. Of course, if completely embedded, the board would not be accessible for programming.

The circuit board 48 is also provided with a number of sets of output terminals 72,74 which permit programming of the circuit. For example, one set of output terminals 72 may be provided on the board 48 to increase or decrease the current rating of the sectionalizer 10 in order to permit a single sectionalizer construction to be employed in different power distribution applications. Such programming may be carried out by repositioning a jumper connector 76 between the terminals to provide predetermined changes in circuit operations.

Thus, by providing a single sectionalizer construction that is programmable, it is possible for a manufacturer or supplier to stock only one type of unit capable of use in any of a plurality of uses. For example, while it is desirable that a sectionalizer used in an underground distribution system be actuated after only one shot, it is preferred that a sectionalizer to be employed in an overhead system be actuated after two or three shots. Either of these system requirements can be satisfied by employing a single sectionalizer construction in accordance with the invention.

Various alternate embodiments of the conductive element 26 are possible with the sectionalizer of the present invention. For example, a conductive element 78 having a V-shaped cross section may be used as shown in FIGS. 4 and 5. In this embodiment, a first housing 80 encases the two current transformers and is mounted externally of the conductive element 78 in close proximity to the control means mounted in a separate housing 82 on the external surface of the conductive element 78. In this first alternate construction, the actuating means includes a detonating device located in the lower casting 84 of the conductive structure which must be replaced after one use. The actuator is detonated by an electrical signal delivered to the actuator from the control means by a lead wire (not shown).

In FIGS. 6–10, additional embodiments of the sectionalizer are illustrated. In FIG. 6, a conductive element 86 having an X-shaped cross section is illustrated. In this second alternate construction, a control means housing 88 is mounted within one of the V-shaped grooves of the conductive element 86. As shown in FIGS. 7 and 8, a C-shaped conductive element 90 includes a central longitudinal cavity in which a control means housing 92 is located, and in FIG. 9 a control means housing 94 is mounted in a longitudinal cavity of an H-shaped conductive element 96. In FIG. 10, a control means housing 98 is mounted between two parallel walls of an open conductive element 100.

The operation of the sectionalizer is illustrated by the schematic diagram of FIG. 11, with the line 102 representing the conductive member which passes through the current transformers 40, 42. As mentioned above, the current transformer 40 serves as the detector and power supply to the control circuit, while the current transformer 42 acts as a power source to the actuator.

The transformer 42 is employed as a power source for activating the actuator 104 and is connected to the actuator through an actuating firing circuit 106 in order to permit control of the activation. The other transformer 40, besides serving as a logic power supply 108, also provides signals used by a magnitude sensing circuit 110, a deadline detector circuit 112, and positive and negative peak detector circuits 114 in detecting when current flow periods occur. These current flow periods which are sensed by the circuits 110, 112, 114 each include a current surge followed by a dead interval during which the current in the conductive element drops off. A decision circuit 116 compares the outputs of the sensing circuits 110, 112, 114 and determines when a period has occurred. Thereafter, the decision circuit 116 counts the periods and activates the actuator firing circuit 106 when a predetermined number of periods has been detected.

One set 74 of output terminals on the circuit board 48, as shown in FIG. 2, permits adjustment of the number of periods which are to be detected prior to energization of the actuator 104. Thus e.g., if the jumper connector 118 is left unattached, the detection of three periods will trigger the energization of the actuator during a following sensed dead interval. The jumper 118 may later be attached between two of the terminals to modify operation of the circuit to energize the actuator after one, two, four or more detected periods. Thus, a variation in the program followed by the circuit is permitted resulting in more flexibility than has previously existed.

Although the invention has been described with reference to the above-described preferred embodiment, it is understood that changes may be made and equivalents employed herein without departing from the scope of the invention as set forth in the claims. For example, although the sectionalizer has been illustrated and described as being pivotally mounted on the contact of the mounting assembly, it is possible to employ a sectionalizer which is mounted for linear sliding movement relative to the contact as disclosed in co-pending U.S. patent application Ser. No. 110,966 filed Oct. 20, 1987.

What is claimed is:

1. A sectionalizer apparatus comprising:

mounting structure including first and second electrical contacts spaced from one another;

rigid electrically conductive structure having an external surface and provided with first and second electrical terminals adapted to engage the first and second electrical contacts of the mounting structure when the sectionalizer is in a closed condition;

release means for releasing the electrically conductive structure from engagement with at least the first electrical contact to permit the electrically conductive structure to move from the closed position to an open position;

actuating means for actuating the release means; and control means for detecting a condition in the sectionalizer and for controlling the actuator in response to the detection, the control means including an electronic control circuit mounted to the external surface of the conductive structure, said conductive structure being capable of carrying the normal electrical current load imposed on the sectionalizer in use, and of sufficient structural strength to support the control means and carry mechanical load applied on the conductive structure by the contacts when the structure is in said closed condition.

2. The apparatus as set forth in claim 1, wherein the electrically conductive structure is a tube having a hollow interior region.

3. The apparatus as set forth in claim 2, wherein the actuating means is disposed in the hollow interior region of the tube.

4. The apparatus as set forth in claim 1, wherein the control means includes detection means for sensing the current through the conductive structure.

5. The apparatus as set forth in claim 4, wherein the detection means includes a current transformer.

6. The apparatus as set forth in claim 1, wherein the control means includes detection means for sensing the condition in the sectionalizer, the detection means including a detector mounted to the external surface of the conductor.

7. The apparatus as set forth in claim 1, wherein the control means includes power means for providing power to the control circuit, the power means being mounted to the external surface of the conductor.

8. The apparatus as set forth in claim 1, further comprising housing means for positioning the control circuit relative to the electrically conductive structure and for protecting the control circuit from exposure to the environment.

9. The apparatus as set forth in claim 1, further comprising housing means for positioning the control means relative to the electrically conductive structure and for protecting the control means from exposure to the environment.

10. The apparatus as set forth in claim 9, wherein the housing means is formed of a potting compound.

11. The apparatus as set forth in claim 10, wherein the control means includes detection means for sensing the condition in the sectionalizer, the detection means including a detector embedded in the potting compound of the housing means.

12. The apparatus as set forth in claim 10, wherein the control means includes power means for providing power to the control circuit, the power means including a current transformer which is embedded in the potting compound of the housing means.

13. The apparatus as set forth in claim 8, wherein the housing means includes an opening through which the control circuit is accessible.

14. The apparatus as set forth in claim 13, further comprising a cover on the opening which protects the control circuit from exposure to the environment and which is manually removable to permit access to the control circuit.

15. The apparatus as set forth in claim 14, wherein the sectionalizer is adapted to operate at a predetermined current rating, the control circuit including a circuit board having at least one set of terminals adapted to permit adjustment of the current rating of the sectionalizer.

16. The apparatus as set forth in claim 1, wherein the condition sensed by the control means is a current flow period including a surge of current through the electrically conductive structure followed by a current dead interval.

17. The apparatus as set forth in claim 16, wherein the actuator is triggered upon detection by the control means of a predetermined number of current flow periods the control circuit including a circuit board having at least one set of terminals adapted to permit adjustment of the predetermined number of current flow periods necessary to trigger the actuating means.

* * * * *